United States Patent [19]

Wittmann et al.

[11] 4,226,470

[45] Oct. 7, 1980

[54] CONVERTIBLE COUCH OR CHAIR

[75] Inventors: Franz Wittmann, Etsdorf; Franz Mitterbauer, Hadersdorf, both of Austria

[73] Assignee: Franz Wittmann Kommanditgesellschaft, Etsdorf, Austria

[21] Appl. No.: 22,477

[22] Filed: Mar. 21, 1979

[51] Int. Cl.[3] ..... A47C 13/00; A47C 17/00

[52] U.S. Cl. ..... 297/108; 5/58; 297/109; 297/111

[58] Field of Search ..... 297/193, 108, 109, 110, 297/111, 105; 5/58

[56] References Cited

U.S. PATENT DOCUMENTS

| | | | |
|---|---|---|---|
| 2,155,490 | 4/1939 | Hoehl . | |
| 2,260,079 | 10/1941 | Lombardi et al. | 297/108 |
| 3,385,631 | 5/1968 | Gertler | 297/111 |
| 3,478,371 | 11/1969 | Viehaus | 5/58 |
| 3,767,258 | 10/1973 | Spence | 297/111 |

FOREIGN PATENT DOCUMENTS

| | | | |
|---|---|---|---|
| 260457 | 3/1968 | Austria . | |
| 851118 | 10/1952 | Fed. Rep. of Germany . | |
| 1076112 | 4/1954 | France | 297/108 |
| 640891 | 8/1950 | United Kingdom | 297/109 |

*Primary Examiner*—James T. McCall
*Attorney, Agent, or Firm*—Karl F. Ross

[57] ABSTRACT

A convertible couch or chair has a normally stationary main frame, a primary seat frame pivotal and slidable on the main frame, a secondary seat frame slidable on the primary seat frame, and a back pivoted on the main frame and on its primary seat frame. The primary seat frame slides at its rear end in upwardly and forwardly inclined guides and links connecting it to the back automatically displace this back on displacement of the primary seat frame away from the main frame from an up position behind a stack of two cushions supported on the primary seat frame into a down position level forming a horizontal continuation of the upper surface of the lower cushion. The secondary frame is formed as a bedding-storage compartment and when pulled drawer-fashion out of the pulled-out primary seat frame serves as a support surface onto which the upper seat cushion can be flopped.

9 Claims, 8 Drawing Figures

CONVERTIBLE COUCH OR CHAIR

FIELD OF THE INVENTION

The present invention relates to a convertible seating unit, or couch or chair that can be transformed into a bed.

BACKGROUND OF THE INVENTION

A standard convertible couch or chair has a seat part which can be pulled out and folded over to form a sleeping surface. To this end complicated linkages are provided that interconnect the various frames that support the mattress in the reclining position. The sleeping surface is normally formed by a mattress that is folded up when the various frames are all fitted together in the sitting position. The uppermost portion of the mattress may serve as a sitting surface in such a chair or couch, or separate cushions may rest thereon to form such a sitting surface.

In order to decrease the length of the mattress needed, it is known to mount the back cushion of such a convertible seating unit so that it can be swung back to form a continuation of the upper surface of the mattress in the sitting position of such a unit. This expedient normally requires that the convertible couch be kept well away from the wall against which it stands, or that it must be pulled away from such a wall before the back can be flopped down. Furthermore it is necessary for the person converting such a seating unit into a bed to lean over the opened mattress part to operate the mechanism that folds down the back, a procedure which is relatively difficult and, in fact, impossible for a small person.

OBJECTS OF THE INVENTION

It is therefore an object of the instant invention to provide an improved convertible seating unit.

Another object is to provide such a unit which can be produced at low cost, yet which is easy to convert from a seating unit into a bed, and which serves comfortably as a seating unit and as a bed.

SUMMARY OF THE INVENTION

These objects are attained according to this invention in a convertible seating unit having a main frame, a primary seat frame, and a secondary seat frame. The seat frames support a pair of cushions, and a seat back is supported between the primary seat frame and the main frame. The seat frames together can move between a rear position within the main frame and a forward position lying ahead of it. Displacement between these two positions automatically displaces the seat back between an up position standing up at the back of the main frame behind the two frames, and a down position level with the seat frames.

More particularly the primary seat frame has its rear end supported in a forwardly and upwardly inclined guide in the main frame and its front end supported via front feet on the floor. A pair of links each have one end connected to the main frame adjacent the front thereof and another end connected to the primary seat frame at approximately its middle. Thus the primary and secondary seat frames are pivoted on these links about sliding centers between the rear seating position and the forward reclining position. The secondary seat frame in its turn is similarly supported in a guide on the primary seat frame, and rides via rollers on the floor. It can be pulled drawer-fashion out of the primary seat frame and is, in fact, constituted as a drawer compartment suitable for storing bedding.

The back is trough-shaped and rearwardly open in the sitting position of the seat frames but downwardly open in the reclining position thereof. More particularly this back is supported by means of a pair of main support links each having an upper end rigidly fixed to the back and a lower end pivoted on the primary seat frame, and by means of a pair of secondary back support links each having an upper end pivoted at the middle of the respective main support link and a lower end pivoted of the main frame. Thus when the seat frames are in the rear sitting position the back will be rigidly supported by means of these four links whereas when pulled forward into the reclining position this back will be rigidly held in a horizontal position.

Upper and lower cushions rest on the primary seat frame and in normal use the lower cushion never moves from the primary seat frame. The upper cushion is hinged at its front edge on the lower cushion, however, so that when the secondary frame is pulled out it can be flopped forwardly onto it to form with the rear seat cushion a horizontal and planar sleeping surface. The upper surface of the back is level with this sleeping surface in the reclining position.

The convertible seating unit according to this invention can be opened up in a few simple motions. First of all the two seat frames are pivoted out, automatically moving the back from the up position into the down position. Then the storage compartment is rolled out, whereupon access can be had to the bedding stored therein, and then the upper cushion is flopped down on top of it. In fact the storage compartment can be slid out even in the sitting position of the main frame. The resultant bed is extremely even, and can employ a relatively good mattress. The seat is formed by a double thickness of this mattress so it in turn can be quite comfortable.

SPECIFIC DESCRIPTION

Figure 1:
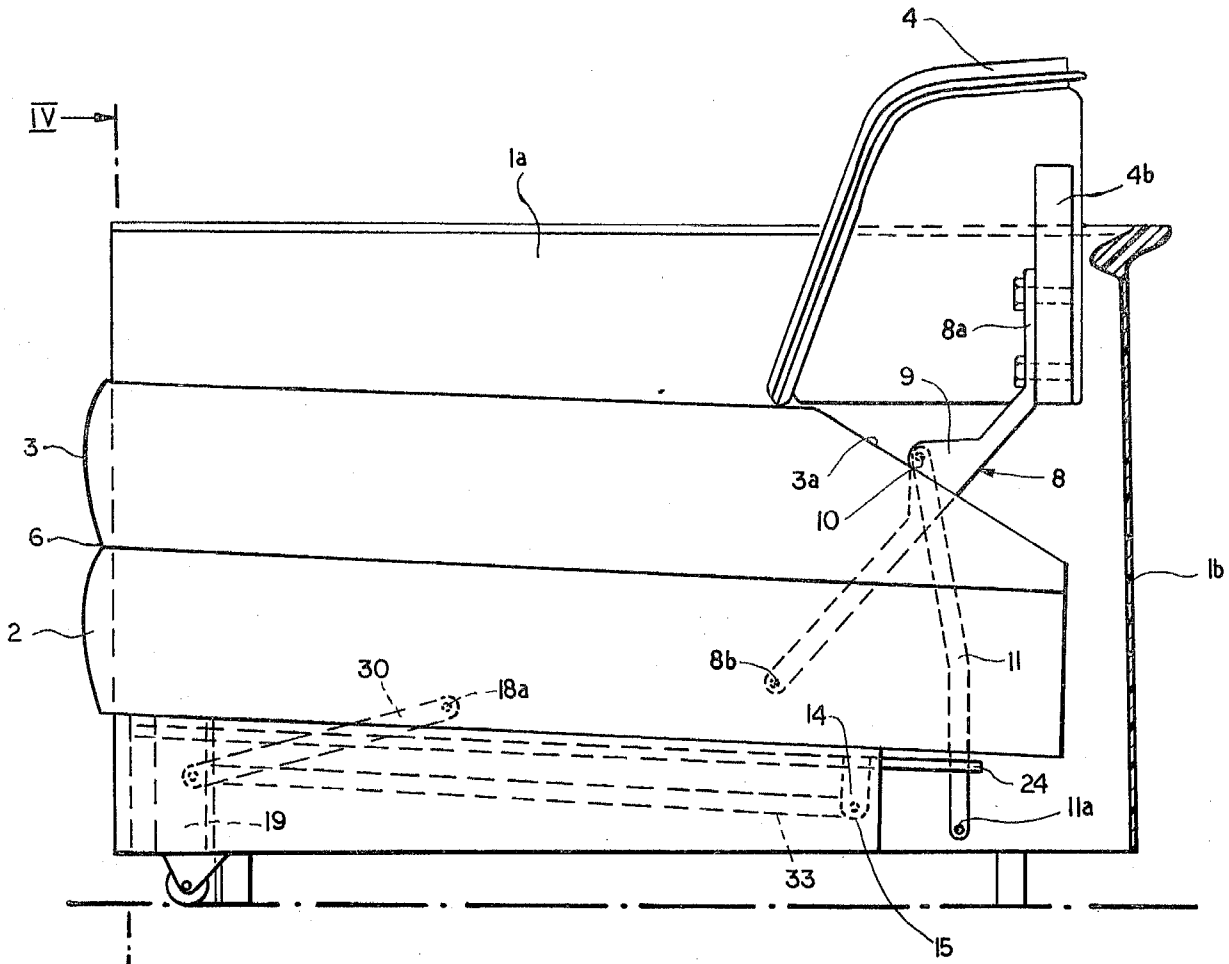
FIG. 1 is a side partly sectional view of the convertible couch according to this invention in the sitting position.
Figure 2:
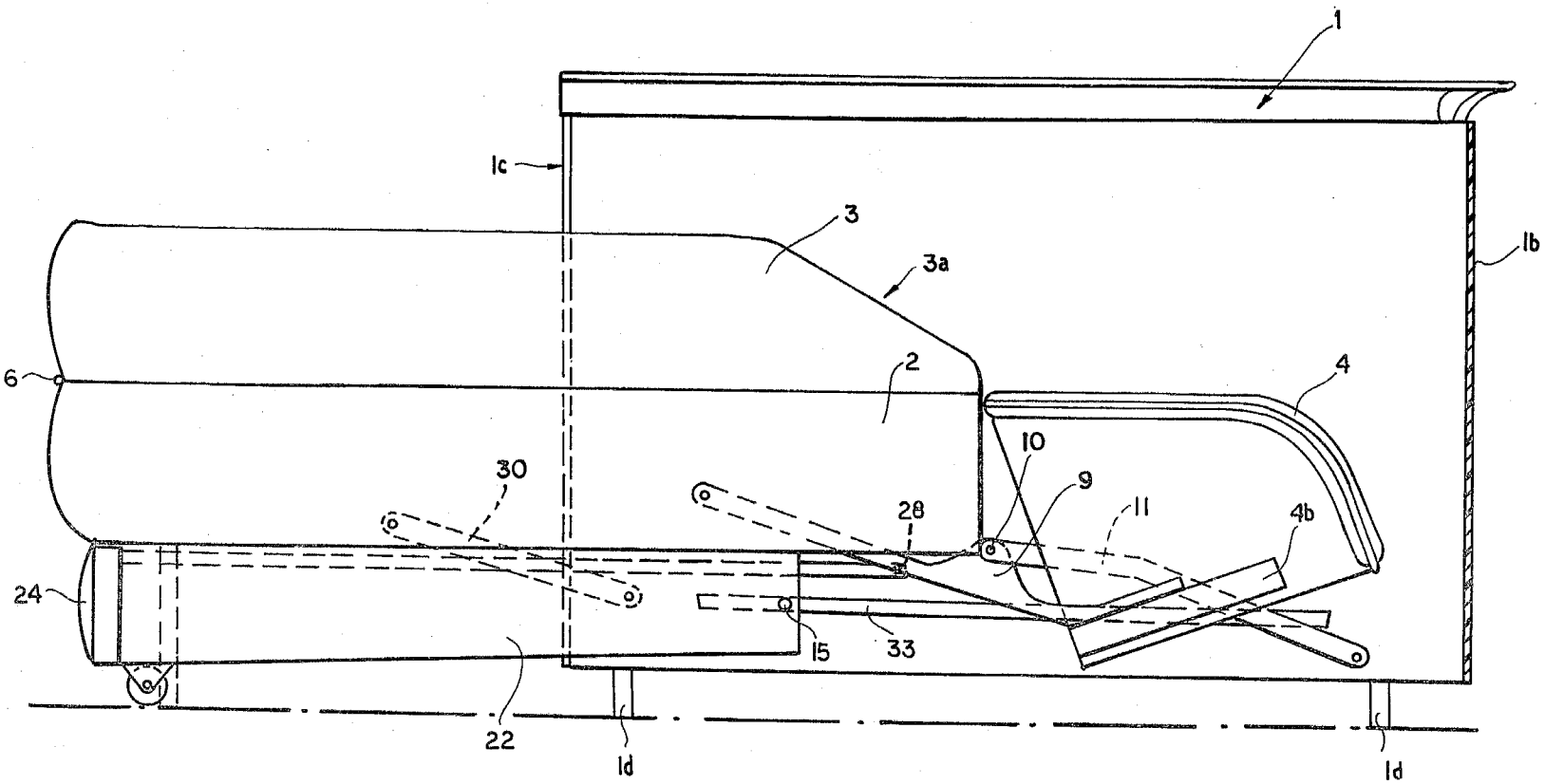
FIG. 2 is a view similar to FIG. 1 showing the couch partly into the reclining position.

As shown in FIGS. 1–4, 6 and 7 a convertible couch has a main frame 1 having a pair of closed sides 1*a*, a closed back 1*b*, and an open front 1*c*, and stands by means of legs 1*d* on the floor.

This main frame 1 incorporates a pair of side plates 31 cut away at their rear ends at 31*a* and front and rear longitudinal members 32*a* and 32*b* interconnecting the respective front and rear legs 1*d*. Each of the side plates 31 is provided with a forwardly upwardly inclined and inwardly open U-section guide rail 33. Each of a pair of links 30 has one end pivoted at 30*a* on a respective side plate 31 ahead of the respective guide rail 33.

A seat back 4 generally shaped as a trough has a pair of longitudinal members 4*a* connected to end members 4*b*. Each of a pair of rigid links has one end 8*a* bolted to a respective element 4*b* and another end 8*b*. In addition respective links 11 are connected at pivots 10 between widened portions 9 on the links 8 and pivots 11*a* on the respective side plate 31 behind the respective U-section guide rails 33. A spacer 10*a* is provided at the pivot 10 and a spacer 11*b* is provided at the pivot pin 11*a*.

Figure 5:
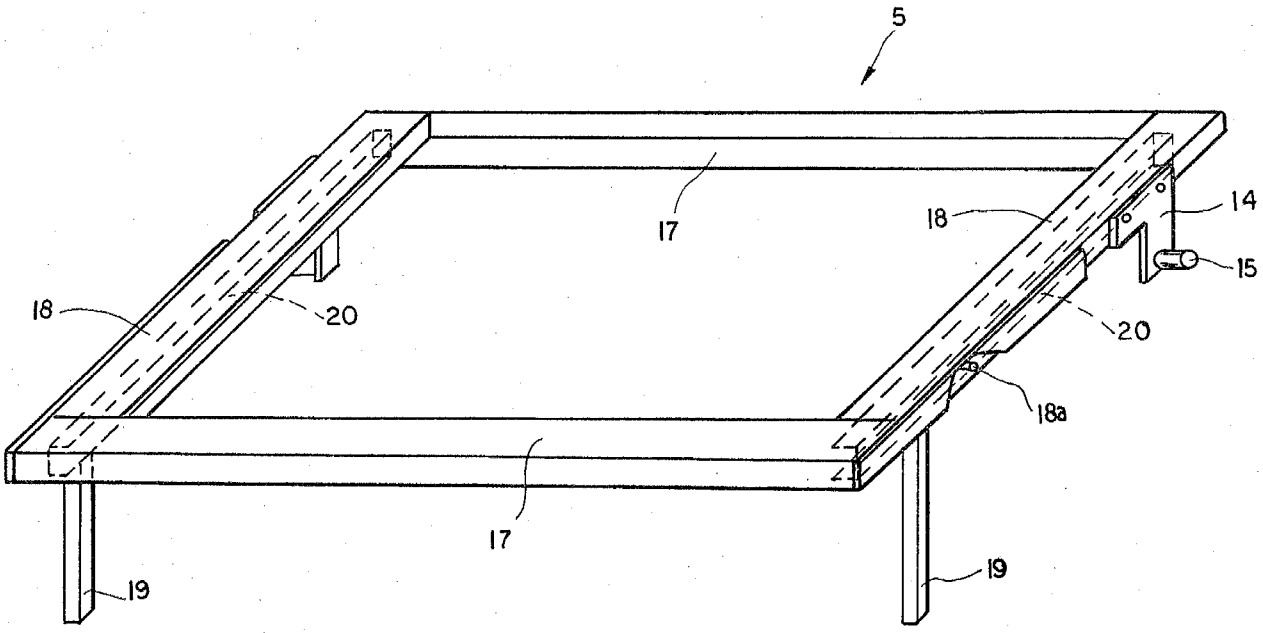
FIG. 5 is a perspective view of the primary seat frame of the couch according to this invention.
Figure 7:
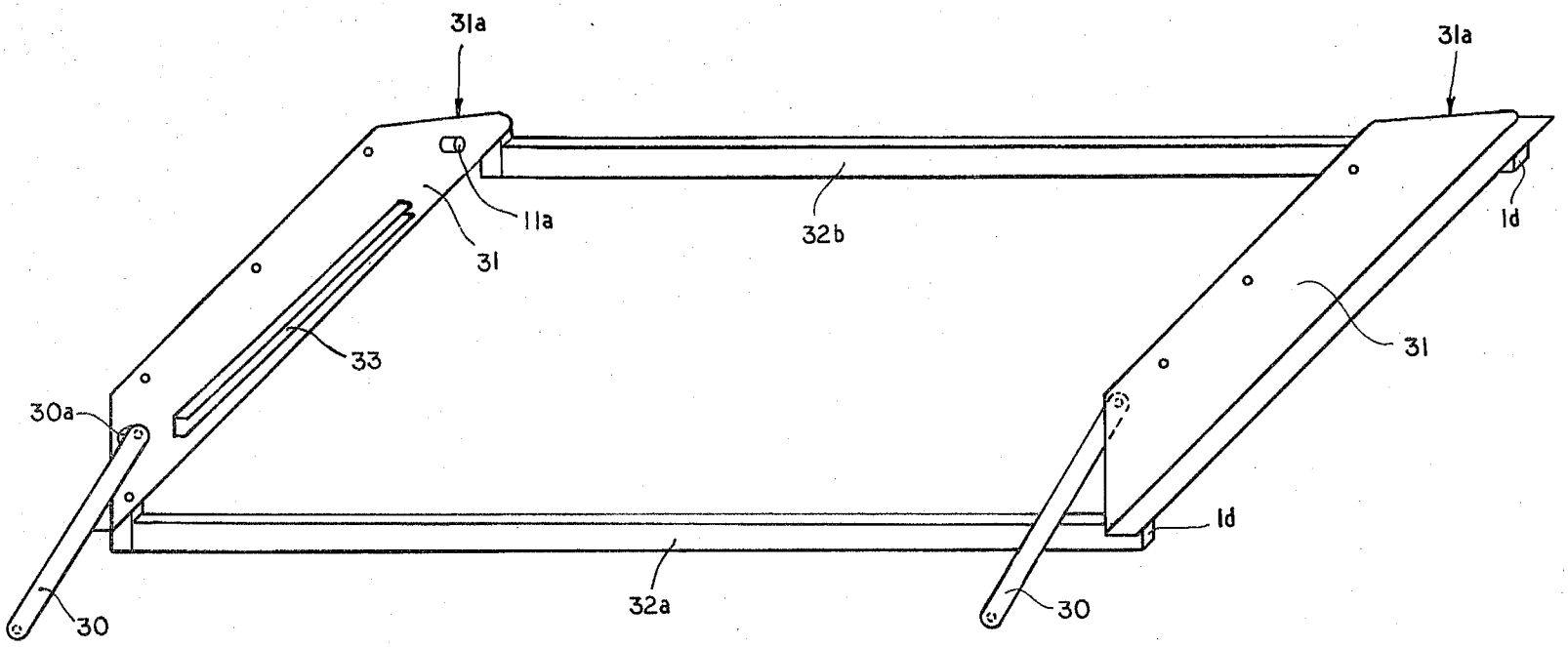
FIG. 7 is a perspective view of the main frame.

A primary seat frame 5 (FIGS. 5 and 6) has a pair of longitudinal members 17 interconnected by a pair of transverse members 18 and is provided with front feet 19 by means of which it can stand on the floor. Each of the transverse members 18 has a pivot pin 18*a* to which is connected the front end of the link 30. In addition each of these transverse members 18 has adjacent its rear end a fitting 14 provided with an outwardly directed pin 15 that is received in the respective guide rail 33 as can be seen by a comparison of FIGS. 5 and 7. A large rectangular lower cushion 2 normally rests atop the frame 5, and an upper cushion 3 with a beveled upper rear corner 3*a* normally rests atop the cushion 2 and is secured by means of a hinge 6 to the lower cushion 2. Both of these cushions are of substantially the same rectangular shape and outline. Furthermore the frame 5 is provided along each of its members 18 with a horizontally extending and inwardly open U-section guide rail 20.

Figure 8:
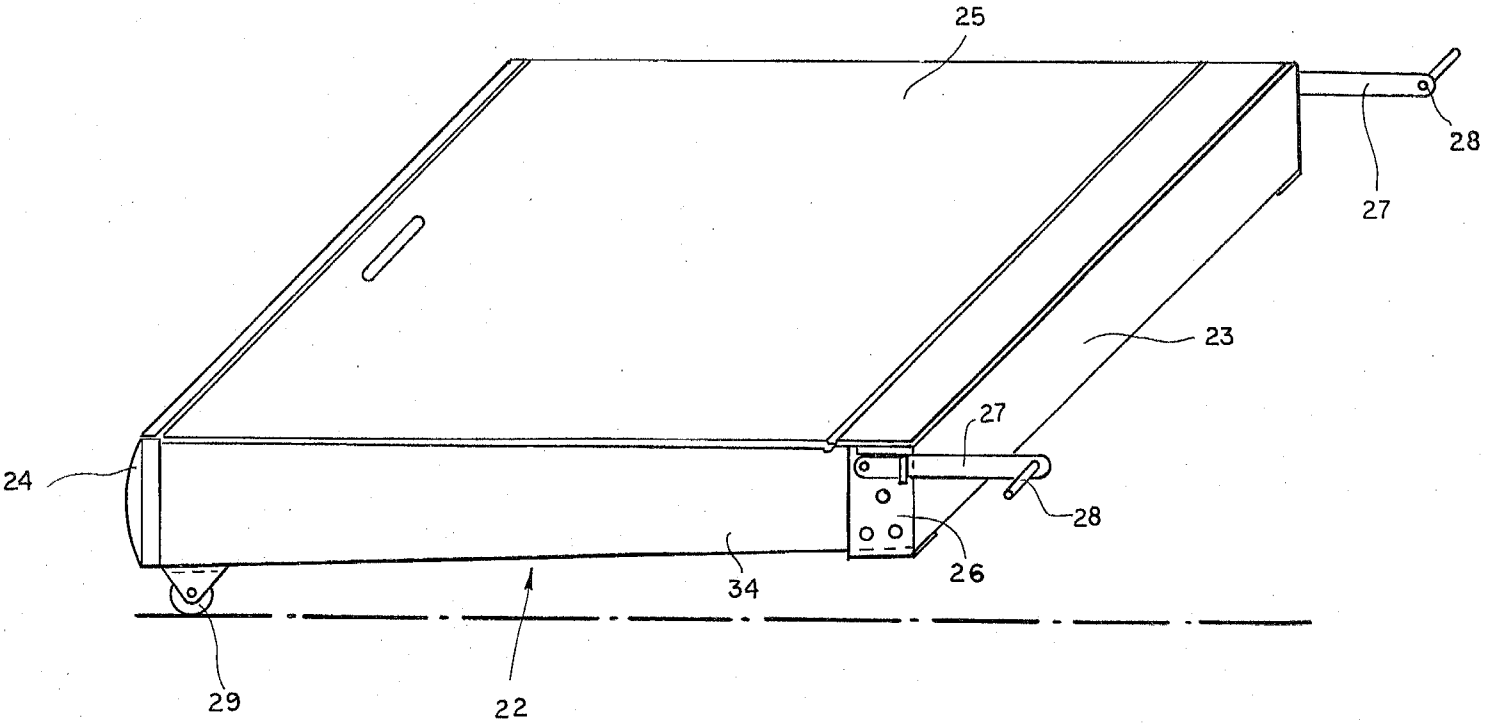
FIG. 8 is a perspective view of the secondary seat frame.

As shown in FIG. 8 a secondary seat frame 22 has a closed rear wall 23, a pair of closed side walls 34, a closed and upholstered front wall 24, and a closed floor (not shown). Furthermore this frame is provided with an openable lid 25 so that it forms a storage compartment easily capable of holding several sheets, blankets and even pillows. At its front end the frame or storage compartment 22 rides via rollers 29 on the floor. At its rear end it has fittings 26 provided with rearwardly extendin arms 27 carrying outwardly directed roller pins 28. The rails 20 receive these roller pins 28 so that the rear end of the secondary frame 22 is supported on the primary frame 5.

The above-described structure is in the position shown in FIG. 1 when used for sitting. In this position the cushions 2 and 3 lie atop of each other, with the lower surface of the cushions lying atop the frame 5. This frame 5 in turn is atop or received within the frame 1, with its rear end supported by means of the pins 15 at the rear ends of the guides 33. In addition the drawer or secondary frame 22 is pushed all the way in and underneath the frame 5 so that its front end 24 is level with the front ends of the cushions 2 and 3, which it identically resembles. Finally the back 4 is in the up position, supported by means of the links 11 extending vertically between the middle portions 9 of the links 8 and the pivots 11*a* and by means of the cushions 2 and 3 and is braced by the links 8.

To convert the seating unit into a bed the primary frame 5 is lifted and simulaneously pulled away from the rear wall 1*b*. This action automatically pivots the back 4 from the position of FIG. 1 to the position of FIG. 2, as it moves the link 11 from an upstanding position to a generally horizontal position and similarly pulls the lower ends 8*b* of the links 8 forwardly. Since the rails 33 are inclined this action will also raise the rear end of the lower cushion 2 to bring this lower cushion 2 into a nearly perfectly horizontal position, level with the lowered back 4.

Figure 3:
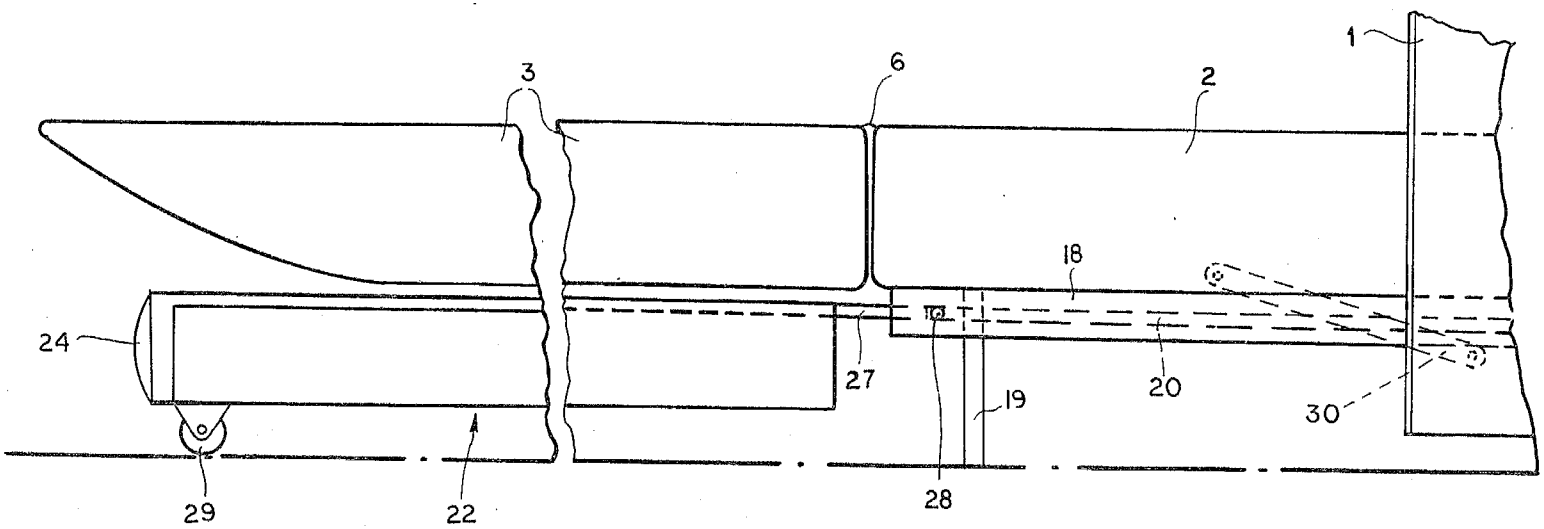
FIG. 3 is a view similar to FIG. 2, but with the rear part not illustrated, showing the structure in the fully reclining position.
Figure 6:
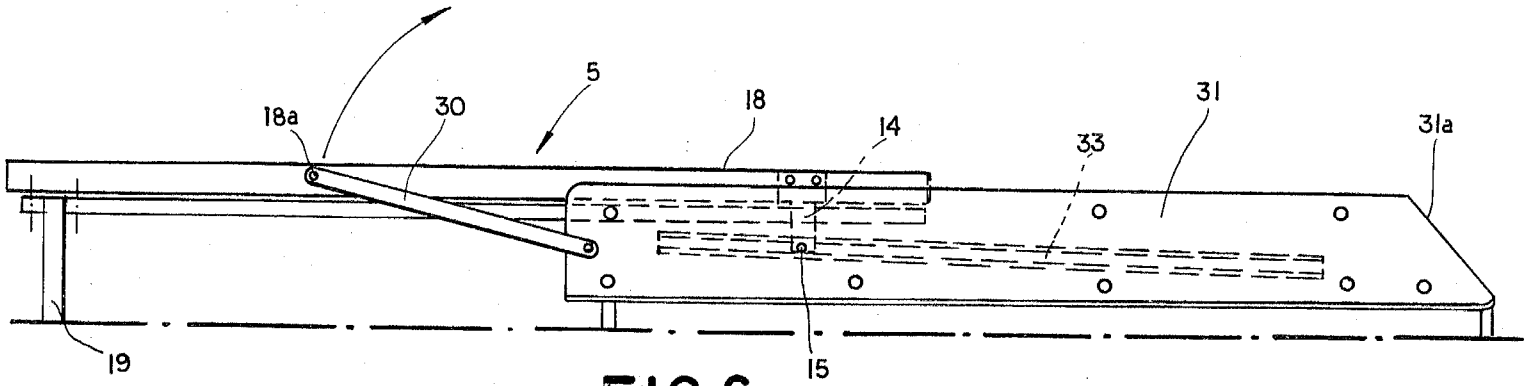
FIG. 6 is a side view showing the main frame and primary seat frame of the couch in the partially extended position.
Figure 4:
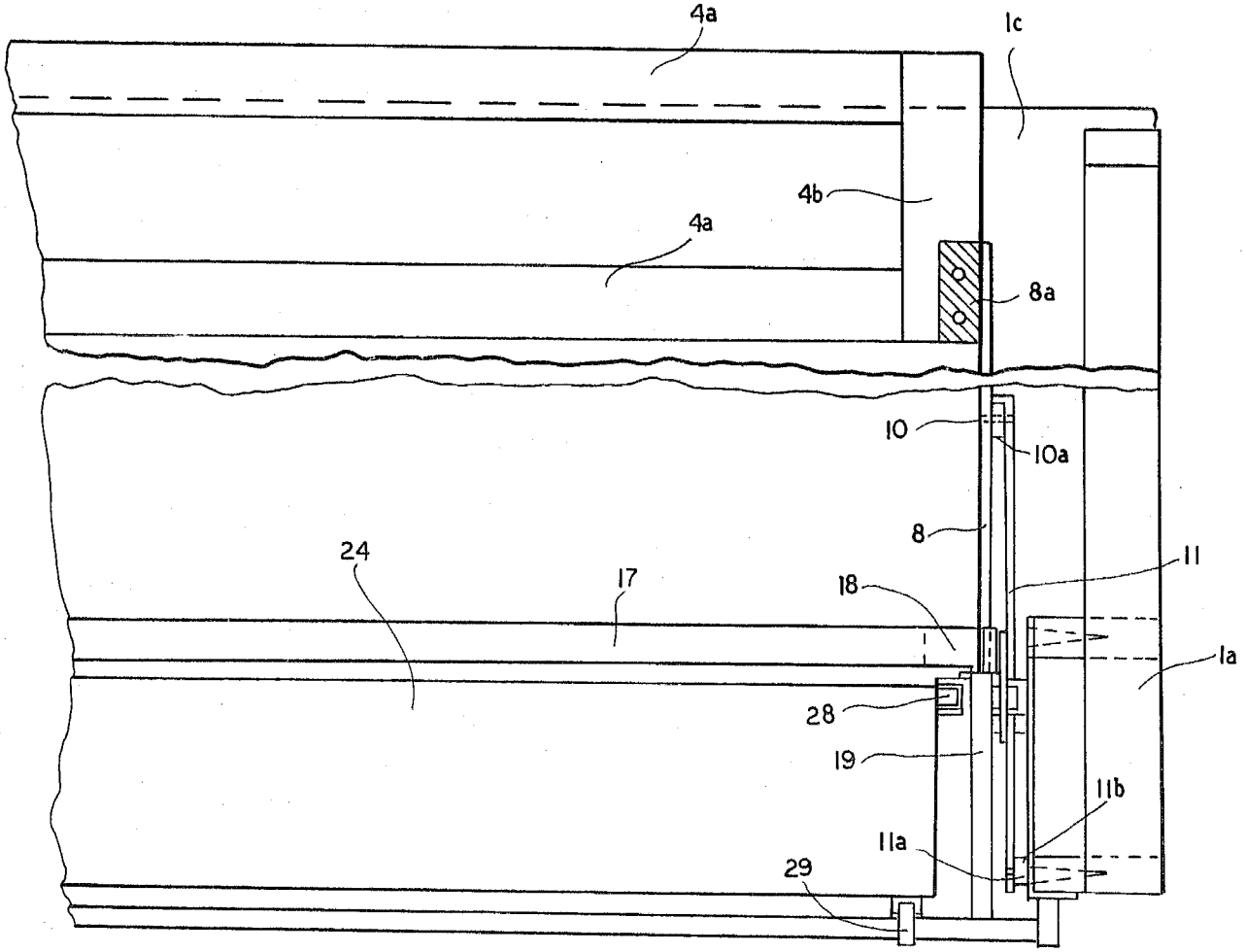
FIG. 4 is a section taken along line IV—IV of FIG. 1.

From this position the front end 24 of the secondary frame 22 is pulled forwardly, rolling on the ground by means of its rollers 29, until it reaches the position shown in FIG. 3. This exposes the upper surface of this frame 22 so that the lid 25 can be opened and bedding can be removed from inside the frame 12. Thereafter the upper cushion 3 is flopped over around its hinge 6 until it lies on top of the lid 25 with its then upper surface level with the upper surface of the cushion 2. The result is a relatively large bed whose rear end is extended by the back 4 so that the two cushions 2 and 3 need not have an excessive overall width. The transformation can be carried out relatively easily, in three simple actions, pivoting out the frame 5, then sliding out the frame 22, and then flopping over the cushion 3, using a relatively modest amount of force. These actions automatically pivot the back 4 forwardly and down into a position level with the lower cushion 2, and pivoting of the cushion 3 forwardly is also an extremely easy task.

At the same time the couch according to this invention can store all the bedding needed for it, so that it constitutes an attractive self-contained unit. Finally it should be noted that the use of the two cushions 2 and 3 atop of each other insures that the couch will be quite comfortable for sitting as well as for sleeping.

We claim:

1. A convertible seating unit comprising:

a main frame adapted to stand on the floor;

a seat frame displaceable on said main frame between a rear sitting position over said main frame and a forward reclining position at least partially in front of said main frame;

a seat on said main frame;

a back;

means interconnecting said back, seat frame, and main frame for automatically displacing said back between an up position above said seat and a down position generally level with and behind said seat on displacement of said seat frame respectively between said rear sitting position and said forward reclining position, said means including:

a pair of links each having one end pivoted on said seat frame and another end pivoted on said main frame, said one ends being behind said other ends in said sitting position and being in front of said other ends in said reclining position;

a forwardly upwardly inclined guide on said main frame; and a formation on said seat frame engaged in said guide and displaceable therealong on displacement of said seat frame between said sitting and reclining positions.

2. The seating unit defined in claim 1 wherein said links include a pair of like first side links each having one end pivoted on said seat frame and another end pivoted on said back.

3. The seating unit defined in claim 2 wherein each of said first side links has a rear end attached to said back and a front end pivoted on said frame.

4. The seating unit defined in claim 1 wherein said seat has upper and lower cushions and said seat frame has a primary frame part and a secondary frame part, said seat frame including means for displacement of said secondary seat part horizontally independently of said primary part between an in position vertically aligned with said primary part and an out position in front of said primary part, said upper cushion being disposable on said secondary frame part in said out position thereof.

5. The seating unit defined in claim 4 wherein said secondary frame part is constituted as a hollow storage drawer, whereby bedding can be stored in said drawer.

6. The seating unit defined in claim 4 wherein said cushions have front edges that are hinged together, said upper cushion being swingable from a position on top of said lower cushion and a position next to and generally level with said lower cushion and resting on said secondary frame.

7. The seating unit defined in claim 1 wherein said guide is a pair of inwardly opening U-section rails.

8. A convertible seating unit comprising:

a main frame adapted to stand on the floor and having a pair of opposite sides, a front, and a back;

a primary seat frame;

a pair of links each having one end pivoted on said main frame adjacent said front and another end pivoted on said primary seat frame, said primary seat frame being pivotal on said links between a rear position overlying said main frame and a front position lying ahead of said main frame;

a secondary seat frame;

guides between said secondary and primary seat frames for displacement of said secondary frame relative to said primary frame between a rear position lying within said primary frame and a front position lying ahead of said primary frame;

means forming a storage compartment in said secondary seat frame;

a lower seat cushion lying on and movable with said primary seat frame an upper seat cushion displaceable between a position lying on said lower cushion and a position lying on said secondary seat frame in said front position thereof;

a seat back; and means including a pair of links between said primary seat frame and said back for automatic displacement of said back on displacement of said primary frame between said rear and front positions between an up position standing up behind said upper cushion and a down position generally level with said lower cushion.

9. A convertible seating unit comprising:

a main frame adapted to stand on the floor;

a seat frame displaceable on said main frame between a rear sitting position over said main frame and a forward reclining position at least partially in front of said main frame;

a seat on said seat frame;

a generally trough-shaped back; and means including links interconnecting said back, seal frame, and main frame for automatically displacing said back between a backwardly open position above said seat and a downwardly open down position generally level with and behind said seat on displacement of said seat frame respectively between said rear sitting position and said forward reclining position.

* * * * *